United States Patent [19]

Shikata et al.

[11] 3,998,691

[45] Dec. 21, 1976

[54] NOVEL METHOD OF PRODUCING RADIOACTIVE IODINE

[75] Inventors: Eiji Shikata; Hiroshi Amano, both of Tokai, Japan

[73] Assignee: Japan Atomic Energy Research Institute, Tokyo, Japan

[22] Filed: July 15, 1974

[21] Appl. No.: 488,681

Related U.S. Application Data

[63] Continuation of Ser. No. 292,252, Sept. 25, 1972, abandoned.

[30] Foreign Application Priority Data

Sept. 29, 1971 Japan ..... 46-75414

[52] U.S. Cl. ..... 176/16

[51] Int. Cl.[2] ..... G21G 1/06

[58] Field of Search ..... 176/14, 16

[56] References Cited

UNITED STATES PATENTS

| | | | |
|---|---|---|---|
| 3,114,608 | 12/1963 | Douis et al. | 176/16 |
| 3,226,298 | 12/1965 | Gemmill | 176/16 |

FOREIGN PATENTS OR APPLICATIONS

| | | | |
|---|---|---|---|
| 1,193,599 | 4/1970 | United Kingdom | 176/16 |
| 763,865 | 12/1956 | United Kingdom | 176/16 |
| 877,333 | 9/1961 | United Kingdom | 176/16 |

OTHER PUBLICATIONS

Journal of Nuclear Science & Technology, vol. 7, No. 9, pp. 481–483, by Shikata.

*Primary Examiner*—Harvey E. Behrend
*Attorney, Agent, or Firm*—Stevens, Davis, Miller & Mosher

[57] ABSTRACT

Radioactive iodine(I-131) is easily obtained by heating, at a temperature ranging from 600° C to 650° C, a tellurium oxide intermediate which was obtained by heating telluric acid or tellurium trioxide at a temperature from about 400° C to 560° C and was irradiated with a neutron flux. Thus, pure I-131 is obtained without the complicated operations required in a conventional process for separation and/or purification of the product.

4 Claims, No Drawings

NOVEL METHOD OF PRODUCING RADIOACTIVE IODINE

This is a continuation of application Ser. No. 292,252, filed Sept. 25, 1972, now abandoned.

BACKGROUND OF THE INVENTION

1. Field of the Invention

This invention relates to a method of producing the radioisotope of iodine, I-131, from a tellurium oxide intermediate irradiated by a neutron flux in a nuclear reactor.

2. Description of the Prior Art

The radioisotope of iodine, I-131 (hereinafter referred to as I-131), has so far been produced from metallic tellurium or tellurium compounds irradiated by a neutron flux. This is, when tellurium is exposed to a neutron flux from a nuclear reactor or other neutron source for a suitable period of time, the isotope of tellurium, Te-130, which is contained in tellurium in the proportion of 34.49%, is converted to radioactive tellurium, Te-131, and this radioactive isotope is converted to I-131 with spontaneous emission of $\beta$-rays. The technical difficulty in the application of the above method resides in the complicated separation process in which pure I-131 in the useful form is to be separated from the tellurium starting material.

Either a wet method or dry method has so far been used for the separation process. With the wet method metallic tellurium powder was, at first, used as a starting material. This material is irradiated with a neutron beam in a nuclear reactor, and then dissolved in a mixture comprising conc. sulfuric acid and chromic acid anhydride. A very vigorous reaction takes place upon the dissolution, and the tellurium is converted to telluric acid and the iodine (I-131) to iodic acid. By adding oxalic acid to the above solution, the I-131 is reduced to elemental iodine and is separated by means of distillation. The I-131 thus obtained is heavily contaminated by the reagents which are used in a large amount in the above process and, therefore, a further purification process is required. The above problem was partly overcome by using telluric acid, which is soluble in water or mineral acids, as a starting material. R. Constant, Journal of Inorganic and Nuclear Chemistry, Vol. 7, pp. 133–139, (1958). By using telluric acid, the separation process is made fairly simple. However, the stability of telluric acid is low at high temperature. This brings about a large disadvantage in irradiation by a nuclear reactor; namely, there is danger that the material will decompose during irradiation and the container for irradiation may burst owing to the increase of internal pressure resulting from generation of gases accompanying the decomposition. On the other hand, with the dry method, which was reported by K. Taugbol and J. B. Dahl in JENER REPORT No. 52, I-131 is separated from the irradiated powder of tellurium dioxide by means of dry distillation at a temperature ranging from 680° – 700° C in an air or oxygen stream. This process does not require complicated dissolution and separation processes which require a large amount of reagents, and the apparatus and the operation are simplified. In addition, with the dry method only I-131 is distilled and the radioactivity of I-131 is not diluted with water, whereas with the wet method water is also distilled with I-131. However, this method has an unavoidable defect in that the final product, distilled I-131, is contaminated by the tellurium volatilized together with I-131. The distillation temperature should be high in order to separate I-131 from said powder efficiently; but at the same time, this increases the volatilization of tellurium, and thereby the purity of the distilled I-131 is lowered.

The present inventors previously found that the above problems could be solved by using tellurium trioxide as a starting material, and completed a novel and excellent method of producing I-131. [See Japanese application No. 23537/1970 and U.S. application Ser. No. 125,337, filed Mar. 17, 1971 now U.S. Pat. No. 3,772,146]. In this method the properties of tellurium trioxide are utilized which comprise stability at temperatures up to about 400° C (i.e. tellurium trioxide does not substantially change chemically), stability under irradiation by the nuclear reactors usually used for research and the thermal property that tellurium trioxide readily releases I-131 included in the crystal lattice accompanying the decomposition that begins at about 400° C. The temperature characteristics of tellurium trioxide, when used as a starting material, result in large advantages over telluric acid which decomposes at about 110° C. Further, the advantages of this method are that I-131 can be recovered with high recovery ratio in a short time at a much lower temperature than is required for the process using tellurium dioxide as a starting material (actually, it is suitable to heat irradiated tellurium trioxide at 450° C in order to promote the decomposition and the accompanying release of I-131 from said material), and moreover, the low distillation temperature eliminates worry about the volatilization of tellurium, which was a defect of conventional methods. However, it is feared that the temperature of such material may be raised higher than about 400° C when it is irradiated with a high density neutron flux in the nuclear reactor used for research in order to produce a large amount of I-131. Accordingly, there are some practical problems in using a large nuclear reactor for the irradiation of tellurium trioxide.

SUMMARY OF THE INVENTION

The object of this invention is to use, as a starting material, a tellurium oxide (hereinafter referred to as tellurium oxide intermediate) characteristics of which are intermediate between those of tellurium trioxide and of tellurium dioxide. That is to say, the tellurium oxide intermediate is more stable at high temperatures than tellurium trioxide and releases I-131 atoms without the volatilization of tellurium at lower temperatures than tellurium dioxide does. Accordingly, the object of this invention is, in other words, to propose a novel method of producing radioactive iodine keeping the advantages of the dry method and removing the defects which reside in prior methods using tellurium dioxide or tellurium trioxide as starting materials, i.e. volatilization of tellurium at the high temperatures which accompany the distillation of I-131 from tellurium dioxide and low stability for a high temperature of tellurium trioxide as mentioned above, by using a tellurium oxide intermediate as a starting material.

In the present invention, the neutron flux density and irradiation time are not especially restricted. One skilled in the art can easily determine a suitable irradiation period according to the neutron flux density to be employed so as to convert Te-130 to Te-131, and, hence, to I-131 of a required quantity. In case it is feared that the temperature will raise as high as the decomposition temperature of the tellurium oxide intermediate by employing a large flux density (e.g. $3 \times 10^{14}$ n/cm$^2$·sec or more), it may be necessary to cool the material in the course of irradiation. The period of time required for the decomposition of the tellurium oxide intermediates depends on the temperature, the amount of the material and the surface area of the material to be treated. The temperature ranges from the decomposition temperature (about 560° C) to about 650° C, preferably from about 600° C. to about 650° C.

DESCRIPTION OF THE PREFERRED EMBODIMENTS

According to the present invention, at first, about 10g of telluric acid is held at a temperature in the range of 500° – 550° C for about 2 hours in an electric furnace in order to prepare a tellurium oxide intermediate. The tellurium oxide intermediate thus obtained is exposed to a neutron flux of a suitable intensity for a suitable period (Irradiation in an nuclear reactor may be convenient from the viewpoint of its supplying a neutron flux with a high density compared with other sources of the flux), then it is transferred to a quartz tube. One end of the quartz tube is connected to a gas absorbing bottle which contains sodium hydroxide aqueous solution with a suitable concentration, the other end being connected to a pump which supplies air to the tube. While supplying air by means of the pump to the quartz tube, the surface of the tellurium oxide intermediate and the gas absorbing bottle in order, the tellurium oxide intermediate is heated to above its decomposition temperature (about 560° C), preferably to about 600° C, and held at that temperature for about two hours in an electric furnace or the like. The final product, I-131, is recovered from the gas absorbing bottle in the form of sodium iodide aqueous solution. In this process, about 80% of the formed I-131 in the irradiated tellurium oxide intermediate is recovered after the first 1 hour, and about 97% is recovered after the first 2 hours. When the temperature is held at about 600° C, no contamination of the final product by volatilized tellurium is detected.

EXAMPLE

About 10 grams of telluric acid, a commercially available chemical, was placed in an electric furnace and was held at 500° C for 2 hours. The decrease in the material by heating was confirmed to be 2.9 grams per 10 grams of said material.

Tellurium oxide intermediate, which is used for the preparation of I-131 according to this invention, was thus obtained. One (1) gram of the tellurium oxide intermediate was enclosed in a quartz tube 0.8 cm in diameter and 5 cm in length, and was placed in a cylindrical aluminum container 2.5 cm in diameter and 11.4 cm in length, for irradiation. The enclosed material was irradiated by a neutron flux of a density of $3 \times 10^{13}$ n/cm$^2$·sec for 10 days in a heavy water-cooled CP-5 type nuclear reactor which was operated with the power of 10 MW. After irradiation, the irradiated material was taken out and was inserted in a quartz tube 2.0 cm in diameter, which was positioned at the center of a cylindrical electric furnace. One end of the quartz tube was connected to a gas absorbing bottle, which contains 20% of 0.5% sodium hydroxide aqueous solution. The other end of the quartz tube was connected to an air pump, from which air was blown through the tellurium oxide intermediate to the absorbing bottle at the flow rate of 50–100 cc/min. The material was held at 600° C for 2 hours. By this process, 97% of the I-131 in the irradiated material was obtained as sodium iodide aqueous solution in the absorbing bottle. The thus obtained I-131 corresponded to the radioactivity of 50 m Ci at the end of the reactor irradiation. No tellurium was detected in the final product.

The "tellurium oxide intermediate", herein used, begins to decompose at 560° C and simultaneously releases I-131 as mentioned precisely latter. This material is more stable, when compared with tellurium trioxide that begins to decompose at 400° C, under the irradiation in severe conditions, namely, with a neutron flux of high density and for a long time. This indicates that said material yields a large amount of I-131 and is useful as a starting material for producing I-131. The temperature at which the material begins to release I-131 is about 560° C (this is higher by about 100° C than the temperature required for tellurium trioxide, namely, 450° C). It is not difficult to work out at such a temperature. Actually, even though it is heated at about 600° – 650° C in order to recover I-131 efficiently, tellurium does not volatilize as does tellurium dioxide when it is used, and pure I-131 can be obtained.

The above preferable embodiment and the example are indicated for the precise explanation of this invention and not to restrict same. It should be certainly understood by one skilled in the art that this invention covers such modifications and variations as come within the spirit and the scope of the appended claims.

For further understanding of this invention, the following main embodiments and their theoretical basis are indicated.

1. The material, tellurium oxide intermediate, is obtained by heating commercially available telluric acid at about 500° C, passing through tellurium trioxide in the course of the decomposition process of telluric acid. Therefore, commercially available tellurium trioxide may be used as a starting material for preparing the tellurium oxide intermediate.

2. The conditions of irradiation by a nuclear reactor can be varied within the scope, as the crystal structure of the material is not changed.

3. I-131, formed in the irradiated tellurium oxide intermediate, is sent to a gas absorbing bottle by means of an air stream. However, the gas is not limited to air and other suitable gases can be used for this purpose, since it is one of the means to send I-131 to a gas absorbing bottle.

4. The sodium hydroxide aqueous solution contained in the gas absorbing bottle is used for collecting I-131 in the form of alkali metal iodide, and, therefore, an aqueous solution of carbonate each of sodium and potassium, thiocarbonate each of sodium and potassium, which have the same effect as said sodium hydroxide does, or a mixture thereof may be also used for this purpose. Also such solution may contain a sulfite or thiosulfide which stabilizes the collected I-131 chemically.

5. Even though distillation of I-131 (namely, isolation of I-131 in the irradiated material from same) begins at about 560° C, for practical purpose it is preferable to heat it at about 600° C to 650° C in order to distil I-131 efficiently. It is useless to heat above 650° C since, by doing so, tellurium will begin to volatilize and no substantial advantage can be obtained since the temperature distribution in an electric furnace is not uniform at such a high temperature.

Tellurium trioxide, $TeO_3$, (i.e. commercially available tellurium trioxide or one which is obtained by heating commercially available telluric acid at about 300° C) begins to decompose above 400° C and converts itself into tellurium dioxide, $TeO_2$, above 560° C, liberating oxygen. The inventors have found that a tellurium oxide (i.e. a tellurium oxide intermediate used in this invention), which is stable for a temperature ranging from about 500° C to about 560° C, can be obtained by carefully heating said tellurium trioxide and maintaining same at about 500° C for a suitable period of time, preferably for 1 to 2 hours. The composition of the oxide can be expressed at TeOn, wherein *n* is between about 2.22, i.e. $2TeO_3.7TeO_2$, and about 2.18, i.e. $2TeO_3.9TeO_2$. Said chemical composition is intermediate between those of $TeO_3$ and $TeO_2$, wherein a part of the crystal structure of $TeO_3$ is converted to that of $TeO_2$ by the release of oxygen accompanying the decomposition. It is confirmed by X-ray diffraction analysis that the crystal structure of the tellurium oxide intermediate used in this invention differs from that of $TeO_2$ or $TeO_3$. Accordingly, it indicates that said tellurium oxide intermediate is not a mere mixture of $TeO_3$ and $TeO_2$. Even though $TeO_3$ is carefully heated, it is difficult in practice to obtain a compound, wherein the composition of which is $TeO_3.nTeO_2$ and *n* is constant. Usually *n* varies between 3.5 and 4.5 as mentioned above. This seems to be caused by the lack of uniformity of temperature in the furnace when $TeO_3$ is heated in an electric furnace. In any case, the compound begins to decompose releasing oxygen at about 560° C and converts to $TeO_2$. If such compound, i.e. the tellurium oxide intermediate, is irradiated by a neutron flux in a nuclear reactor and then is heated, it actually begins to release I-131 near the temperature of 500° C. This results from the diffusion of I-131 atoms enclosed in the crystal lattice of the irradiated tellurium oxide intermediate. The rate of the release is slow and, therefore, it is not practically useful. When the tellurium oxide intermediate is heated gradually above a temperature of about 500° C, the rate of the release of I-131 brought about by the diffusion increases with the increase in temperature, and when the temperature reaches about 560° C, the release of I-131 suddenly becomes rapid. At this temperature, the tellurium oxide intermediate converts to tellurium dioxide as mentioned above, and simultaneously the solid geometrical rearrangement of the component atoms (crystal structure transition) occurs within the crystal. It can be explained as follows: as the result of said reaction brought about by the irradiation of the tellurium oxide intermediate with a neutron flux, I-131 atoms are produced within the irradiated material, and, although the I-131 at ms included in the crystal lattice of the material are observed to be released gradually by diffusion in solid phase above the temperature of about 500° C, said atoms are suddenly released rapidly from the crystal lattice at the temperature of 560° C, accompanying the thermal decomposition of the irradiated material and the following crystal structure transition at that temperature. In a practical process, the tellurium oxide intermediate is preferably heated at a temperature in the range of from about 600° C to about 650° C in order to promote the decomposition of said material, and, consequently, to obtain I-131 effectively. However, heating above 650° C should be avoided since it may bring about the volatilization of tellurium.

What we claim is:

1. A process for producing radioactive iodine (I-131) comprising:

heating a compound selected from the group consisting of: telluric acid and tellurium trioxide, at a temperature in the range of about 500° to 560° C to obtain a tellurium oxide intermediate having a composition $TeO_3.nTeO_2$, where *n* is in the range from about 3.5 to about 4.5, irradiating said tellurium oxide intermediate with a neutron flux to form I-131 in said intermediate, and converting the irradiated intermediate to tellurium dioxide by pumping a carrier gas therethrough while heating said irradiated intermediate at a temperature in the range of its decomposition temperature up to about 650° C, thereby releasing said I-131.

2. The process according to claim 1, in which the conversion is effected at a temperature in the range of about 560° – 650° C.

3. The process according to claim 1, in which the irradiation is effected to a degree sufficient to convert a substantial amount of the Te-130 contained in the tellurium oxide intermediate to Te-131.

4. The process according to claim 1, in which the irradiation is effected in a nuclear reactor.

* * * * *